US010415763B2

(12) United States Patent
Eckert

(10) Patent No.: US 10,415,763 B2
(45) Date of Patent: Sep. 17, 2019

(54) LED-FILAMENT AND ILLUMINANT WITH LED-FILAMENT

(71) Applicant: OSRAM Opto Semiconductors GmbH, Regensburg (DE)

(72) Inventor: Tilman Eckert, Tanjung Tokong (MY)

(73) Assignee: OSRAM Opto Semiconductors GmbH, Regensburg (DE)

( * ) Notice: Subject to any disclaimer, the term of this patent is extended or adjusted under 35 U.S.C. 154(b) by 0 days.

(21) Appl. No.: 16/075,360

(22) PCT Filed: Feb. 4, 2016

(86) PCT No.: PCT/EP2016/052341
§ 371 (c)(1),
(2) Date: Aug. 3, 2018

(87) PCT Pub. No.: WO2017/133770
PCT Pub. Date: Aug. 10, 2017

(65) Prior Publication Data
US 2019/0049073 A1 Feb. 14, 2019

(51) Int. Cl.

| | |
|---|---|
| ***F21K 9/232*** | (2016.01) |
| ***F21K 9/90*** | (2016.01) |
| ***F21V 29/87*** | (2015.01) |
| *F21Y 101/00* | (2016.01) |
| *F21V 29/85* | (2015.01) |
| *F21Y 103/10* | (2016.01) |
| *F21Y 115/10* | (2016.01) |
| *F21Y 107/70* | (2016.01) |

(52) U.S. Cl.
CPC ..... *F21K 9/232* (2016.08); *F21K 9/90* (2013.01); *F21V 29/87* (2015.01); *F21V 29/85* (2015.01); *F21Y 2101/00* (2013.01); *F21Y 2103/10* (2016.08); *F21Y 2107/70* (2016.08); *F21Y 2115/10* (2016.08)

(58) Field of Classification Search
CPC . F21K 9/232; F21K 9/90; F21V 29/87; F21Y 2107/70; F21Y 2115/10; F21Y 2103/10
See application file for complete search history.

(56) References Cited

U.S. PATENT DOCUMENTS

2012/0268936 A1* 10/2012 Pickard ..... F21K 9/90 362/249.02
2013/0265796 A1 10/2013 Kwisthout
2013/0301252 A1* 11/2013 Hussell ..... F21K 9/232 362/184
2015/0069442 A1* 3/2015 Liu ..... H01L 33/504 257/98
2016/0302300 A1* 10/2016 Shashkov ..... C25D 11/02

FOREIGN PATENT DOCUMENTS

WO 2015/135817 A1 9/2015

* cited by examiner

*Primary Examiner* — Kevin Quarterman
(74) *Attorney, Agent, or Firm* — DLA Piper LLP (US)

(57) ABSTRACT

A filament for a filament lamp includes a plurality of light emitting semiconductor chips, wherein the light emitting semiconductor chips are located on a carrier board, the light emitting semiconductor chips are electrically connected, and the carrier board is a flexible carrier board.

14 Claims, 4 Drawing Sheets

LED-FILAMENT AND ILLUMINANT WITH LED-FILAMENT

TECHNICAL FIELD

This disclosure relates to a filament, an illuminant and a production method of an illuminant.

BACKGROUND

Classic filament lamps have a bad degree of efficiency, regarding transformation of electrical power to optical power. To overcome these efficiency issues, light emitting diodes (LEDs) have been introduced to illuminants. To implement the LEDs and complex heat sink designs, these kinds of illuminants are designed significantly different to the traditional incandescent light bulb design.

It could therefore be helpful to provide an illuminant in the form of a filament lamp and a filament with LED technology, allowing for a bent shape of the filament as well as to provide a production method for such an illuminant.

SUMMARY

I provide a filament for a filament lamp including a plurality of light emitting semiconductor chips, wherein the light emitting semiconductor chips are located on a carrier board, the light emitting semiconductor chips are electrically connected, and the carrier board is a flexible carrier board.

I also provide an illuminant including the filament including a plurality of light emitting semiconductor chips, wherein the light emitting semiconductor chips are located on a carrier board, the light emitting semiconductor chips are electrically connected, and the carrier board is a flexible carrier board, a bulb including a transparent material, wherein the filament is located within the bulb, the bulb is filled with a gas, the gas is in contact with the filament and the bulb is closed.

I further provide a method of producing the illuminant, including providing a flexible carrier board with circuit paths; placing light emitting semiconductor chips on top of the flexible carrier board; placing the flexible carrier board within a transparent bulb; filling the bulb with a gas; and sealing the gas bulb to prevent leaking of the gas from the bulb.

REFERENCE NUMERALS

Figure 1:
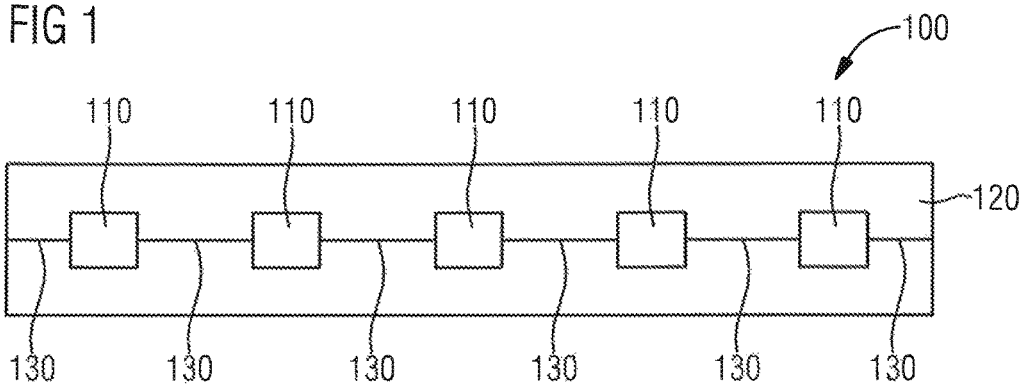
FIG. 1 schematically shows a top view of a filament.

100 filament
110 semiconductor chip

111 first electrical contact pad
112 second electrical contact pad
113 first semiconductor chip
114 second semiconductor chip
115 third semiconductor chip
116 fourth semiconductor chip
120 flexible carrier board
121 first winding
122 second winding
123 third winding
124 fourth winding
125 fifth winding
130 contact area
140 conversion layer
150 contact pin
200 illuminant
210 first contact wire
220 second contact wire
230 bulb
240 socket

DETAILED DESCRIPTION

My filament for a filament lamp comprises a plurality of light emitting semiconductor chips or LEDs. These light emitting semiconductor chips are located on a carrier board and electrically connected. The carrier board is a flexible carrier board. In contrast to the usually used rigid carrier boards, flexible carrier boards allow for a design of the LED filament resembling the classic filament for a filament lamp. Flexible in this context means, that the carrier board can be bent by an angle above 90°.

The filament may further comprise a converter that converts a wavelength of light emitted from the light emitting semiconductor chips to light of another wavelength. With this approach, white light can be obtained.

The filament may comprise a first electrical connector pad and a second electrical connector pad and the electrical connector pads each connect to a contact pin. The contact pins can then be used to mount the filament into a filament lamp.

The flexible carrier board may be a flexible circuit board. Flexible circuit boards are extensively used in modern electronics and thus easily available. Flexible circuit boards exhibit features needed for a filament resembling the classical filament design.

The flexible carrier board may comprise metal circuit paths arranged on top of a flexible polymer film. This polymer film particularly contains polyester, polymide, polyethylene naphthalate, polyetherimide, fluropolymers and copolymers of the aforementioned. These materials are widely used for flexible electric circuit boards and therefore easily available and producible. The thickness of the polymer film can be 12 to 125 microns. Thinner and thicker materials are also possible.

The filament and thus its flexible carrier board may be arranged in a bent shape. This means, that the flexible carrier board is bent by an angle of more than 45 degrees, preferably more than 90 degrees.

The flexible carrier board may be arranged in the form of a spiral coil. Arranging the flexible carrier board in the form of a spiral coil leads to a filament closely resembling the traditional filament of a filament lamp.

The light emitting semiconductor chips may be arranged linearly and equally spaced with a distance between centers of two adjoining light emitting semiconductor chips on top of the flexible carrier board. The equally spaced arrangement of the light emitting semiconductor chips leads to a uniform emission of the light of the light emitting semiconductor chips.

The circumference of a winding of the spiral coil may differ from an integer multiple of the distance between the centers of the adjoining light emitting semiconductor chips. Therefore, for adjoining windings of the spiral coil, the semiconductor chips are not positioned right next to each other and thus improve the thermal flow of heat from the semiconductor chips.

The circumference of a winding of the spiral coil may differ from an integer multiple of the distance between the centers of the adjoining light emitting semiconductor chips by an amount of half this distance. Therefore, for adjoining windings of the spiral coil, a semiconductor chip on the first winding adjoins the middle of the gap between two semiconductor chips of the adjacent second winding. Therefore, the thermal properties of a coil like this are improved and the light emission is more homogeneous.

The semiconductor chips on a first winding may be located at given rotational angles relating to a center line of the coil. The semiconductor chips on a second winding are located at rotational angles relating to a center line of the coil different from the given rotational angles on the first winding.

The semiconductor chips on a first winding may be located at given rotational angles relating to a center line of the coil. The semiconductor chips on a second winding are located at rotational angles relating to a center line of the coil in a way that the semiconductor chips on the first winding are located at a position on the first winding corresponding to a position of a center of a gap between two semiconductor chips on the second winding.

An illuminant comprises a filament and a bulb comprising a transparent material. The filament is located within the bulb and the bulb is filled with a gas. The gas is in contact with the filament and the bulb is closed. With an illuminant like this, the heat produced within the filament can be transported away from the semiconductor chips through the gas with which the bulb is filled. Therefore, a cooling of the semiconductor chips of the filament is possible.

The gas may be helium. Helium is a well-suited choice for the gas within the bulb, as the thermal conductivity of helium is high.

The pressure of the gas within the bulb may be 500 to 1200 mbar. With a pressure within this range, improved heat transfer from the filament is achieved.

A method of production of an illuminant comprises the following steps:

providing a flexible carrier board with circuit paths;

placement of light emitting semiconductor chips on top of the flexible carrier board;

placement of the flexible carrier board within a transparent bulb;

filling the bulb with a gas; and sealing the gas bulb to prevent leaking of the gas from the bulb. With this production method, an illuminant resembling the classic light bulb design can be achieved.

The flexible carrier board may be arranged in a bent shape. The flexible carrier board may be arranged in the form of a spiral coil.

A converter may be placed before the flexible carrier board is placed within the bulb. This allows for an easy production of the filament on top of the flexible carrier board before the placement of the filament.

A converter may be placed after the flexible carrier board is brought to its final shape, particularly by a spray coating process. This allows for an easy process to obtain a filament resembling the traditional filament of a traditional light bulb.

The above described properties, features and advantages as well as the method of obtaining them, will be more clearly and more obviously understandable in the context of the following description of examples, which are explained in more detail in the context of the figures.

FIG. 1 shows a top view of a filament 100 for a filament lamp. The filament 100 comprises a plurality of light emitting semiconductor chips 110 located on a flexible carrier board 120. The light emitting semiconductor chips 110 electrically connect by contact areas 130.

Figure 2:
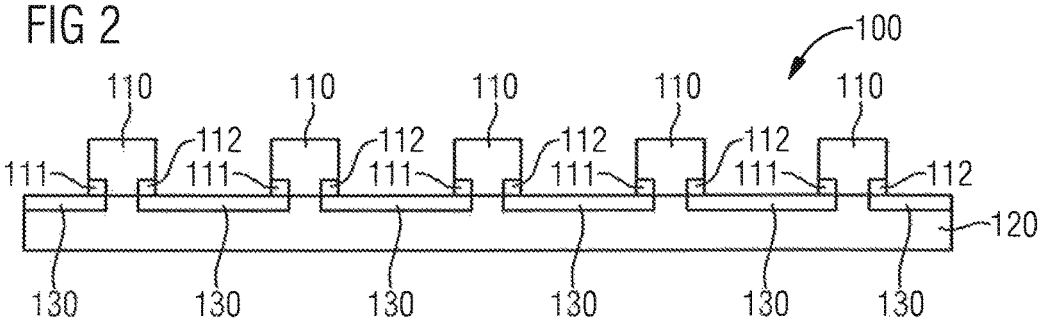
FIG. 2 schematically shows a cross section of a filament.

FIG. 2 shows a cross section of the filament 100 of FIG. 1. The semiconductor chips 110 comprise a first electrical contact pad 111 and a second electrical contact pad 112 on a side of the semiconductor chip 100 facing the flexible carrier board 120. The contact areas 130 are formed in a way, that the contact areas 130 connect the second electrical contact pad 112 of a semiconductor chip 110 with the first electrical contact pad 111 of an adjoining semiconductor chip 110. Therefore, the semiconductor chips 110 are serially coupled.

Another way of electrically connecting the semiconductor chips 110 may be used. For example, at least some of the semiconductor chips 110 may be connected in parallel.

The filaments 100 of FIGS. 1 or 2 can comprise contact pads electrically connected to the contact areas 130. These contact pads can be used to electrically connect the filament 100 to an external voltage- or current-source. The connection to the external source can be established via a spot-welding, a soldering or a gluing process. If a gluing process is used, it is advantageous to use an electrically conductive glue.

Figure 3:
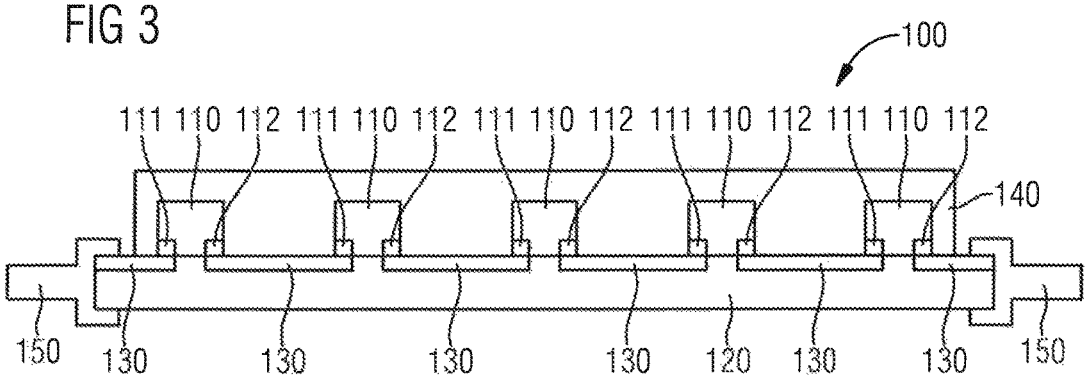
FIG. 3 schematically shows a cross section of a filament with converter and contact pins.

FIG. 3 shows a cross section through a filament 100 with the features of the filament of FIG. 2. Additionally, the semiconductor chips 110 are arranged within a conversion layer 140. This conversion layer 140 is capable of converting a wavelength of light emitted from the light emitting semiconductor chips 110 to light of another wavelength. Therefore, for instance white light can be achieved. On the left hand side and the right hand side of the flexible circuit board 120 two contact pins 150 are located, which are in electrical contact with the contact areas 130. These contact pins 150 can be used to mount the filament 100 within a bulb.

It is also possible to just implement the conversion layer 140 without the contact pins 150 and vice versa.

Alternatively, it is possible that a converter is placed on top of the semiconductor chips 110 individually before the placement of the semiconductor chips 110 on top the flexible carrier board 120 or after the placement of the semiconductor chips 110 on top of the flexible carrier board 120. Additionally, a second conversion layer in the form of the conversion layer 140 of FIG. 3 is possible.

The flexible carrier board 120 may be a flexible circuit board 120. The flexible circuit board consists of metal circuit paths, which are the contact areas 130. The bulk material of the flexible circuit board 120 is a flexible polymer film. This polymer film can contain polyester (PET), polymide (PI), polyethylene naphthalate (PEN), polyetherimide (PEI), fluoropolymers (FEP) and copolymers of the aforementioned. The thickness of the flexible circuit board 120 can be 12 microns to 125 microns.

The flexible carrier board 120 may comprise a flexible material and supports the semiconductor chips 110. The electrical connection of the semiconductor chips 110 is established using bond wires.

Figure 4:
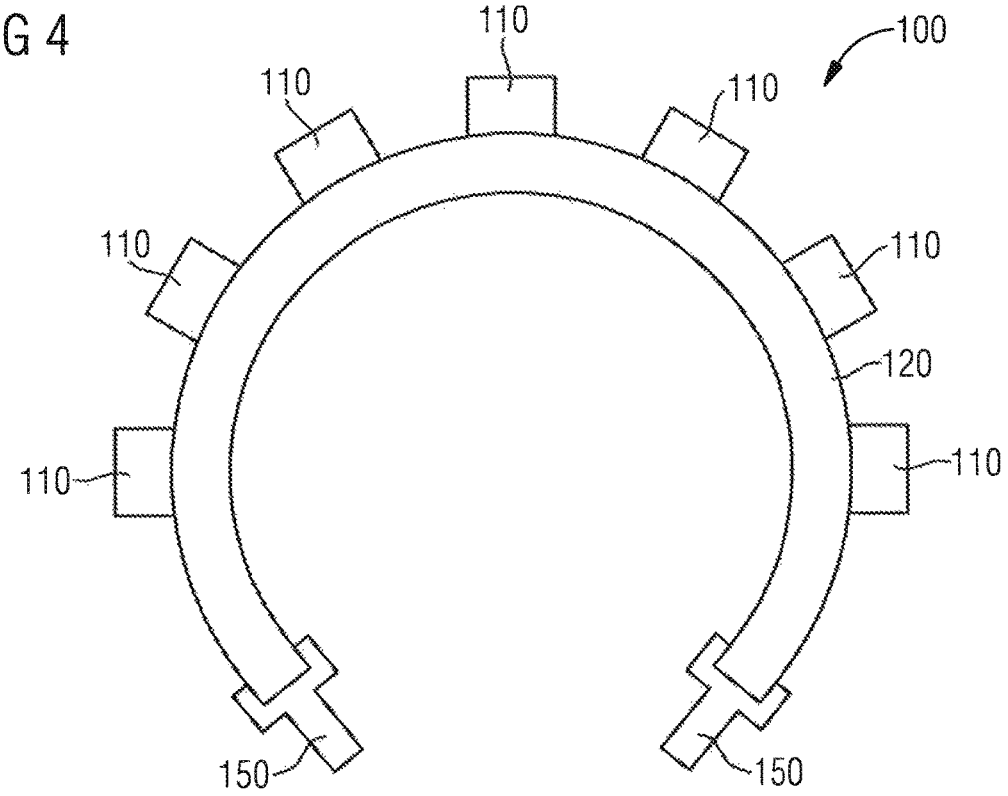
FIG. 4 schematically shows a cross section of a bent filament.

FIG. 4 shows the filament 100 of FIGS. 1 and 2 with additional contact pins 150. The flexible carrier board 120 is arranged in a bent shape, constituting three quarters of a full circle. The light emitting semiconductor chips 110 are located on the outside of this three quarter circle. This filament 100 more closely resembles the filament traditionally used in filament bulbs, allowing for an illuminant with increased overall similarity to this traditional light bulb. Also, other shapes like wavelike shapes, zigzag shapes or semicircles are possible and more closely resemble the filament traditionally used in filament bulbs.

The contact pins 150 can be used to electrically connect the filament 100 to an external voltage- or current-source. The connection to the external source can be established via a spot-welding, a soldering or a gluing process. If a gluing process is used, it is advantageous to use an electrically conductive glue.

Figure 5:
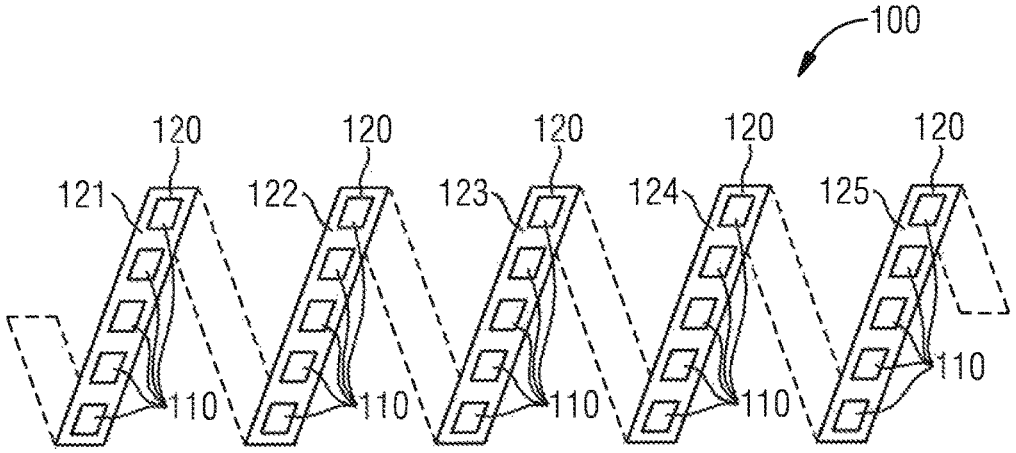
FIG. 5 schematically shows a top view of a filament arranged in the form of a spiral coil.

FIG. 5 shows a top view of a filament 100 with many light emitting semiconductor chips 110 on top of a flexible carrier board 120. The flexible carrier board 120 is arranged in the form of a spiral coil. This coil consists of five windings 121, 122, 123, 124, 125. It is also possible to design a spiral coil with fewer or more windings. The first winding 121 and the second winding 122 are next to each other. The circumference of a winding 121, 122, 123, 124, 125 of the spiral coil of the filament 100 is similar to an integer multiple of the distance between the centers of two adjoining light emitting semiconductor chips 110. Therefore, the semiconductor chips 110 are on the same position for each winding 121, 122, 123, 124 and 125. This filament 100 more closely resembles the classic filament of a classic light bulb.

Figure 6:
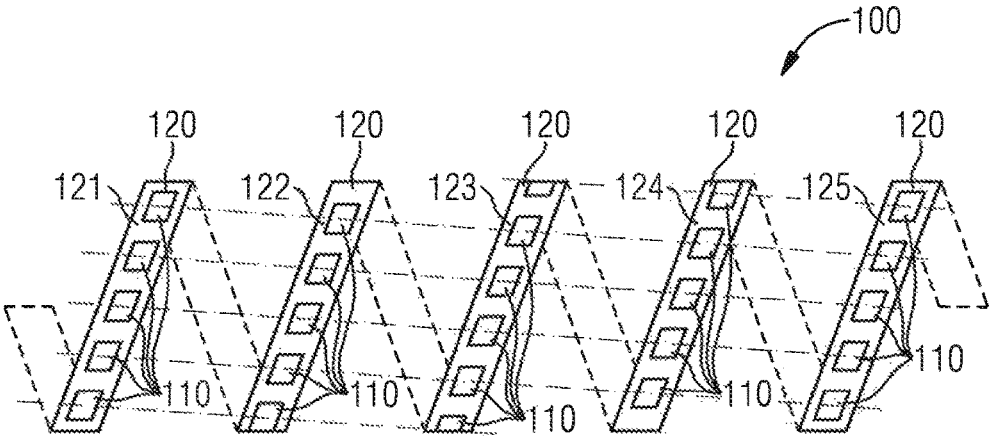
FIG. 6 schematically shows a top view of another filament arranged in the form of a spiral coil.

FIG. 6 shows a top view of a filament in the form of a spiral coil basically similar to the filament shown in FIG. 5. In contrast to the filament 100 shown in FIG. 5, the circumference of a winding 121, 122, 123, 124, 125 of the spiral coil formed by the flexible carrier board 120 differs from an integer multiple of the distance between the centers of the adjoining light emitting semiconductor chips 110. Therefore, the position of the light emitting semiconductor chips 110 is different for each winding indicated by dash lines throughout the filament 100. Using this approach, the thermal properties of the filament are improved.

Figure 7:
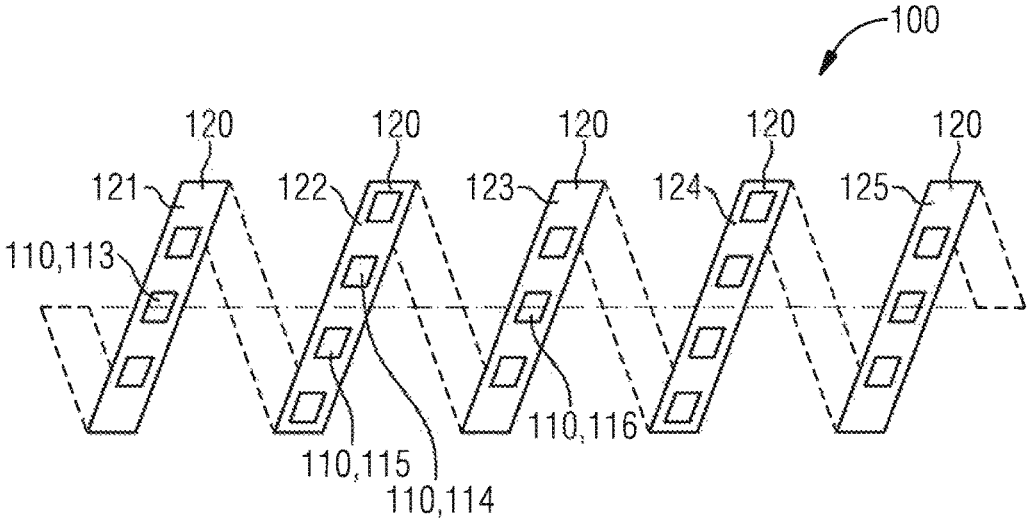
FIG. 7 schematically shows a top view of a third example of a filament arranged in the form of a spiral coil.

FIG. 7 shows a top view of a third filament 100 in the form of a spiral coil with basically the properties of FIGS. 5 and 6. For the spiral coil of the filament of FIG. 7, the circumference of a winding 121, 122, 123, 124, 125 differs from an integer multiple of the distance between the centers of the adjoining light emitting semiconductor chips 110 by an amount of half this distance. This means, that on the first winding 121 a first semiconductor chip 113 is located. At this position, the second winding 122 exhibits the middle of the gap between a second semiconductor chip 114 and a third semiconductor chip 115. A fourth semiconductor chip 116 on the third winding on the other hand is located at this very spot again. This distance relation also holds true for the other semiconductor chips 110 of the filament 100. This leads to a filament 100 with optimized thermal properties.

Figure 8:
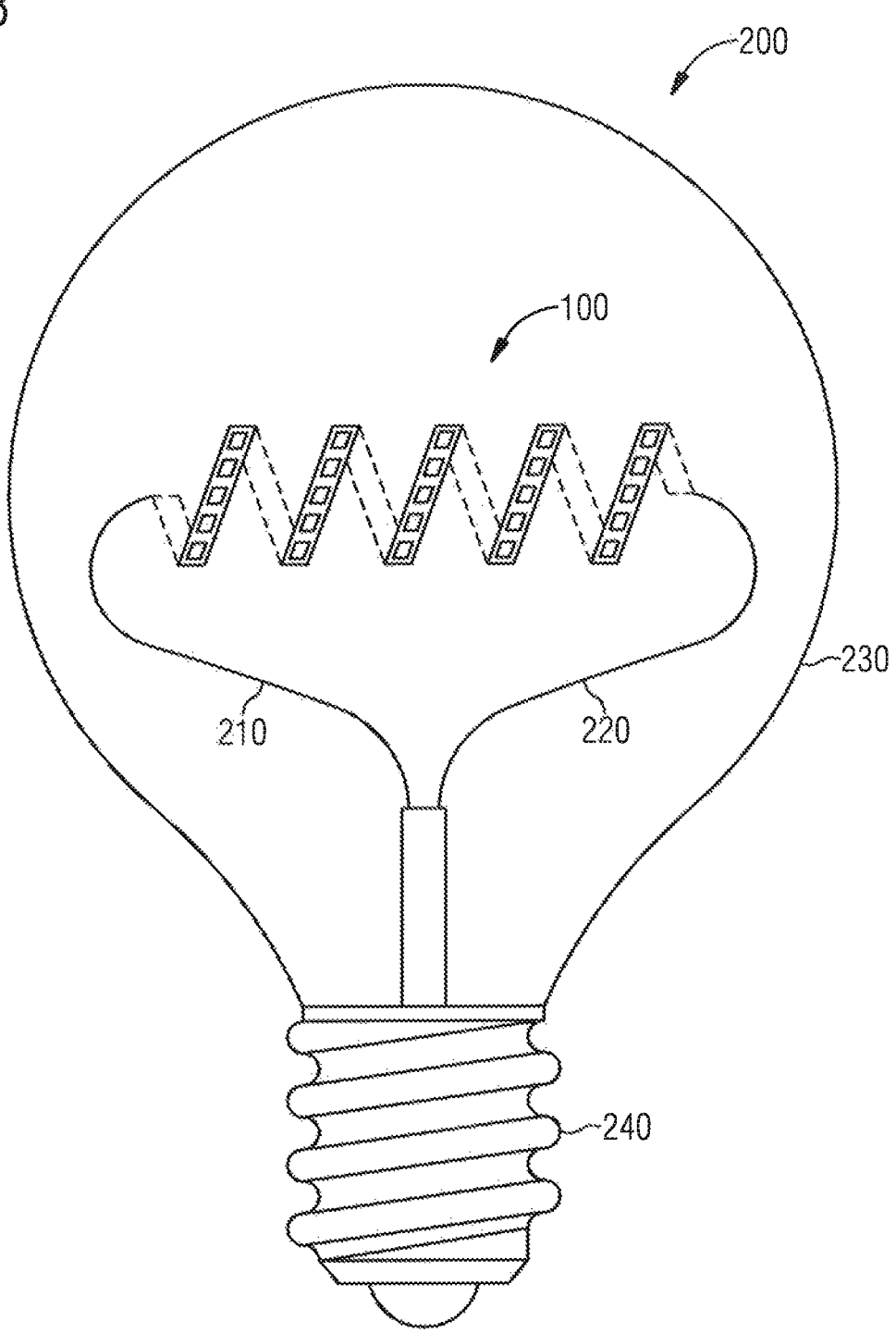
FIG. 8 schematically shows a light bulb with such a filament.

FIG. 8 shows an illuminant with a filament 100, which is one of the filaments of FIGS. 5 to 7. It is also possible, but not shown in FIG. 8, that the filament 100 is similar to one of the filaments depicted in FIGS. 1 to 4. The filament 100 connects to a socket 240 with a first contact wire 210 and a second contact wire 220 in electrical contact only via the filament 100. Around the filament and attached to the socket 240 a bulb 230 is placed. The bulb 230 and the socket 240 form a closed entity, which is filled with a gas. This gas therefore is in thermal contact with the filament 100 and leads to thermal conductivity from the filament 100 to the bulb 230.

The gas within the bulb 230 may be helium. The gas within the bulb 230 may have a pressure of 500 to 1200 mbar.

A method of production of an illuminant according to FIG. 8 comprises the following steps:

providing a flexible carrier board 120 with circuit paths 130;

placement of light emitting semiconductor chips 110 on top of the flexible carrier board 120;

placement of the flexible carrier board 120 within a transparent bulb 230;

filling the bulb 230 with a gas; and sealing the gas bulb 230 to prevent leaking of the gas from the bulb 230.

The last sealing process can be performed by implementing a socket 240 to the bulb 230. Another possibility is to connect the bulb 230 to the socket 240.

The flexible carrier board 120 may be arranged in a bent shape within the bulb 230. The flexible carrier board 120 may be arranged in the form of a spiral coil.

A converter may be placed on top of the flexible carrier board 120 before the flexible carrier board 120 is placed within the bulb 230. A converter may be placed after the flexible carrier board 120 is brought to its final shape, particularly by a spray coating process. In this case, it is possible to place the converter after the spiral coil is formed.

Although my LED-filaments and illuminants are described and illustrated in more detail using preferred examples, this disclosure is not limited to these. Variants may be derived by those skilled in the art from the examples without leaving the scope of the appended claims.

The invention claimed is:

1. A filament for a filament lamp comprising a plurality of light emitting semiconductor chips, wherein the light emitting semiconductor chips are located on a carrier board, the light emitting semiconductor chips are electrically connected, and the carrier board is a flexible carrier board, wherein the flexible carrier board is arranged in a bent shape, the flexible carrier board is arranged in the form of a helical coil, the semiconductor chips on a first winding are located at given rotational angles relating to a center line of the coil, and the semiconductor chips on a second winding are located at rotational angles relating to a center line of the coil different from the given rotational angles on the first winding.

2. The filament according to claim 1, further comprising a converter that converts a wavelength of light emitted from the light emitting semiconductor chips to light of another wavelength.

3. The filament according to claim 1, wherein the filament comprises a first electrical connector pad and a second electrical connector pad, and the electrical connector pads each connect to a contact pin.

4. The filament according to claim 1, wherein the flexible carrier board is a flexible circuit board.

5. The filament according to claim 1, wherein the flexible carrier board comprises metal circuit paths arranged on top of a flexible polymer film, the polymer film containing polyester (PET), polyimide (PI), polyethylene napthalate (PEN), Polyetherimide (PEI), fluropolymers (FEP) and copolymers thereof.

6. The filament according to claim 1, wherein the light emitting semiconductor chips are arranged linearly and equally spaced with a distance between centers of two adjoining light emitting semiconductor chips.

7. The filament according to claim 1, wherein the semiconductor chips on a first winding are located at given rotational angles relating to a center line of the coil, and the semiconductor chips on a second winding are located at rotational angles relating to a center line of the coil in a way that the semiconductor chips on the first winding are located at a position on the first winding corresponding to a position of a center of a gap between two semiconductor chips on the second winding.

8. The filament according to claim 1, wherein the circumference of a winding of the spiral coil differs from an integer multiple of the distance between the centers of the adjoining light emitting semiconductor chips by an amount of half the distance between the centers of the adjoining light emitting semiconductor chips.

9. An illuminant comprising the filament according to claim 1, a bulb comprising a transparent material, wherein the filament is located within the bulb, the bulb is filled with a gas, the gas is in contact with the filament and the bulb is closed.

10. The illuminant according to claim 9, wherein the gas is helium.

11. The illuminant according to claim 9, wherein a pressure of the gas is 500 to 1200 millibar.

12. A method of producing the illuminant according to claim 9, comprising:

providing a flexible carrier board with circuit paths;

placing light emitting semiconductor chips on top of the flexible carrier board;

placing the flexible carrier board within a transparent bulb;

filling the bulb with a gas; and sealing the gas bulb to prevent leaking of the gas from the bulb, wherein the flexible carrier board is arranged in a bent shape, the flexible carrier board is arranged in the form of a helical coil, the semiconductor chips on a first winding are located at given rotational angles relating to a center line of the coil, and the semiconductor chips on a second winding are located at rotational angles relating to a center line of the coil different from the given rotational angles on the first winding.

13. The method according to claim 12, wherein a converter is placed before the flexible carrier board is placed.

14. The method according to claim 12, wherein a converter is placed after the flexible carrier board is brought to a final shape by a spray coating process.

* * * * *